US005125462A

United States Patent [19]

Hesse

[11] Patent Number: 5,125,462

[45] Date of Patent: Jun. 30, 1992

[54] QUICK-CHANGE RAM BORING HEAD

[75] Inventor: Alfons Hesse, Lennestadt, Fed. Rep. of Germany

[73] Assignee: Paul Schmidt, Lennestadt, Fed. Rep. of Germany

[21] Appl. No.: 445,400

[22] Filed: Dec. 4, 1989

[30] Foreign Application Priority Data

Dec. 5, 1988 [DE] Fed. Rep. of Germany ..... 3840923

[51] Int. Cl.[5] ..... E21B 11/02

[52] U.S. Cl. ..... 175/19; 175/135; 175/293; 173/118; 173/122; 173/133

[58] Field of Search ..... 175/19, 135, 293, 299, 175/381, 414; 173/13, 116, 118, 122, 128, 131, 133; 299/94; 403/146, 348, 349

[56] References Cited

U.S. PATENT DOCUMENTS 1,566,630 12/1925 Sturtevant ..... 173/121
1,859,342 5/1932 Rea ..... 403/349
2,507,585 5/1950 Bassinger ..... 175/299 X
2,634,951 4/1953 Snyder ..... 175/299 X
3,049,109 8/1962 Schley ..... 173/118
4,462,468 7/1984 Jenne ..... 173/121
4,548,278 10/1985 Gidlund ..... 173/121
4,632,195 12/1986 Emmerich ..... 403/348 X
4,658,913 4/1987 Yantsen et al. ..... 173/134 X

*Primary Examiner*—Thuy M. Bui
*Assistant Examiner*—Roger J. Schoeppel
*Attorney, Agent, or Firm*—Akoo-Toren

[57] ABSTRACT

In a ram boring machine that has a striking piston reciprocating in a tubular housing and a striking tip that may be formed as a chisel and projects from the housing, connection of the striking tip to the housing by means of a bayonet joint makes installation and removal or replacement of the striking piston or a worn chisel possible in a simple manner.

4 Claims, 4 Drawing Sheets

QUICK-CHANGE RAM BORING HEAD

TECHNICAL FIELD OF THE INVENTION

The invention relates to a ram boring machine having a striking piston reciprocating in a tubular housing and a striking tip.

BACKGROUND OF THE INVENTION AND PRIOR ART

A ram boring machine of this kind is disclosed in German patent specification 21 57 295; it primarily serves to lay supply lines, for example water pipes or cables, beneath streets or embankments or other buildings and obstacles, without the street surface or the surface of the ground having to be torn up simultaneously. This is done by the ram boring machine moving forwards in the ground forcing the earth aside and forming a tunnel behind it into which a supply line can be simultaneously or subsequently drawn.

This known ram boring machine has a two-part housing, i.e. a housing tip screwed into the housing accommodating the striking piston. The housing tip encloses an axially movable chisel with its front end, in the working or striking direction, formed as a striking tip and having at its other end a collar and a shank, the collar being received by a bore in the housing tip. This arrangement of the movable chisel has the advantage that the impact energy of the striking piston can first be transferred positively to the chisel so that greater shattering energy is available. The shank forms the striking surface for the associated striking piston, and in the starting position before the working stroke it projects from a ring screwed into the housing tip in the housing. The ring limits the movement of the collar, and thus of the chisel, counter to the working direction of the striking tip. The movement of the chisel in the working direction is limited by a front stop formed by a widening in the bore in the housing tip accommodating the collar. The chisel is supported on the housing tip by the collar and compression springs; the springs move the chisel from its forward position in the housing tip in the working direction back into its starting position.

Apart from the ram boring machine with the two-part housing described above, ram boring machines are also known in which the housing and the housing tip are in one piece; apart from this there are no substantial differences between a two-part and a one-part machine housing. A common feature of all ram boring machines is that during the forward movement of the ram boring machine the chisel, which breaks up and forces aside the stones or other obstacles, thus clearing a path by impact for the housing moving up behind, is worn considerably owing to the shattering work it has to perform, and must therefore be replaced often.

OBJECT OF THE INVENTION

It is an object of the invention to improve the operation of a ram boring machine of the kind described in the introduction and to simplify the installation and removal or replacement of the striking tip and/or the chisel.

SUMMARY OF THE INVENTION

To this end, according to the invention, the striking tip, which may also be formed as a chisel, is connected to the housing by means of a bayonet catch. The invention thus makes use of the discovery that the principle of a "one turn" or bayonet connection can advantageously be used to secure a striking tip and/or a chisel in the housing of a ram boring machine.

In the case of a two-part machine housing the entire front housing can also be connected to the main housing in this way and be locked in its fitting position. If, as is preferable, a shank of the chisel is provided with at least one radial shoulder segment that engages, on the side remote from the chisel, behind at least one internal collar of the housing having an axial passage adapted to the shoulder segment, the chisel or the chisel head can be connected to the housing simply by pushing them axially together, i.e. insertion into the machine housing, followed by radial rotation. By means of securing means to prevent rotation, for example a pin inserted transversely through the housing, the chisel can be arrested in its fitting position so as not to rotate; in addition the securing pin counteracts accidental loosening during operation.

It is advantageous if a chisel collar comprising two diametrically opposed shoulder pieces is used, and is arranged in a housing chamber having a front and a rear stop limiting the path of movement of the chisel. For example, the end walls of the housing chamber, which may be formed as a pressure chamber, may serve as stops to limit the stroke of an axially movable chisel.

The housing chamber can advantageously be arranged between two internal collars of which at least the front internal collar, in the striking direction, is provided with two diametrically opposed axial passages corresponding to the chisel collar. This makes it possible, particularly when the ram boring machine is used in soft ground in which the chisel encounters far less resistance than in hard ground, either for the chisel collar to strike the front internal collar, which is securely attached to the housing, or for the striking piston to strike the rear internal collar, which is securely attached to the housing, so that the energy from the striking piston is always transferred via the large area of the internal collar, which is securely attached to the housing. The rear internal collar is struck after the shank of the chisel projecting from the internal collar towards the striking piston has been displaced into a position that is at least flush with the outer surface of the internal collar.

A compression spring can be arranged between a supporting ring, arranged non-rotatably on the chisel, which engages with at least one shoulder segment behind the rear internal collar on the side remote from the chisel, and a counterpart ring on the chisel shank. After a working stroke of the striking piston this spring always returns the chisel to its starting position in which the chisel collar bears against the rear stop and the shank projects from the rear internal collar and is thus always acted on by the striking piston.

The counterpart ring advantageously comprises two half shells and is arranged in a peripheral groove in the chisel shank. Inserting and fastening the corresponding ring in the peripheral groove makes it possible to position the compression spring and the supporting ring securely on the chisel shank before inserting the chisel into the housing, so that there is a complete chisel unit.

According to a preferred embodiment of the invention a front stop for the striking tip—which may be a chisel—can be integral with the stop surface that is acted on by and limits the forward stroke of the striking piston. The one-piece construction, i.e. with the stop surfaces for both the striking piston and for the chisel or its collar located on the same machine part, makes it possible to further improve the operation of the ram boring machine, particularly when it is used in soft ground.

If, as is advantageous, the chisel is arranged in a housing tip detachably connected to the main housing, the one-piece construction can be brought about in a simple manner by means of a component that can be connected to the machine housing in the manner of a bayonet joint. In this case the ram boring machine has a two-part housing, namely comprising the main housing accommodating the striking piston and the housing tip provided with the chisel. This housing tip or this front housing can, for example, be secured to the main housing by being screwed into it from inside or on to it from outside, or by friction or positive (shape) locking. Both the stops for the chisel collar and the stop for the striking piston, namely the front face of the housing tip, are on the same component or are made available by this component, the housing tip.

In the case of a two-part machine housing it is advantageous if the end of the chisel shank facing the main housing projects from the housing tip and if the length of the projection is not longer than the maximum stroke of the chisel between the stops. In a construction such as this in which the length of projection of the chisel shank is thus smaller or the same as the maximum stroke of the chisel, operation of the ram boring machine in soft ground can be improved. Thus after the chisel has been moved forward by an amount corresponding to the length of projection of the shank, the striking piston strikes full on the front face of the housing tip so that the striking energy is absorbed over a large area and transmitted to the housing with as little loss as possible.

BRIEF DESCRIPTION OF THE DRAWINGS

The invention will now be described in more detail with reference to the exemplary embodiment of chisel fastening means shown in the drawings, in which.

DETAILED DESCRIPTION OF A PREFERRED EMBODIMENT OF THE INVENTION

Figure 1:
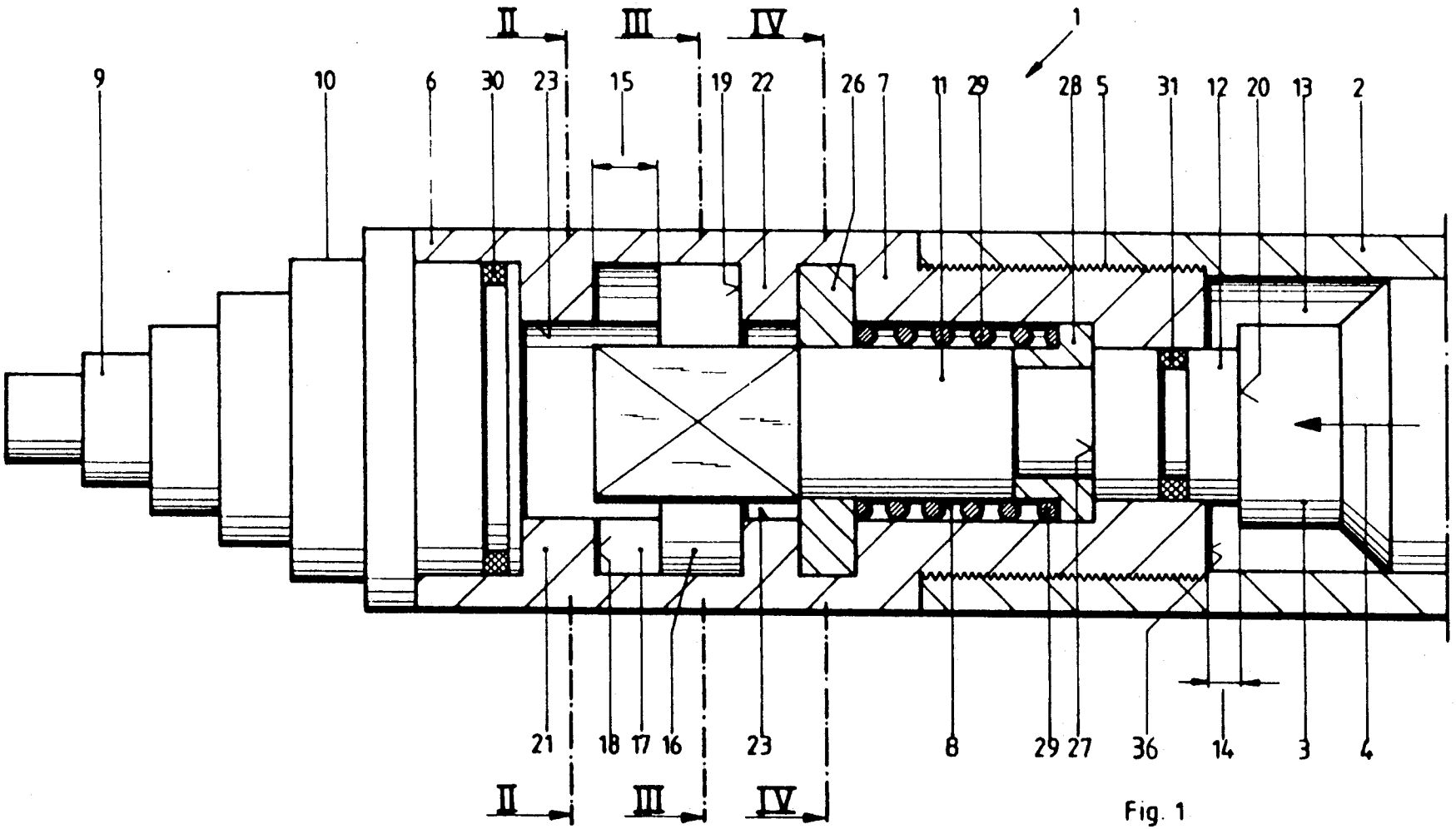
FIG. 1 shows in longitudinal section the front part of a ram boring machine, i.e. a housing tip connected to a chisel by a bayonet joint screwed into a main housing.

Only the front part of a generally tubular housing 2 of a ram boring machine 1 is shown. A striking piston 3, only the front end of which is shown, is guided to reciprocate in the housing 2. The striking piston 3 receives its striking energy from compressed air supplied to the rear end of the housing 2. Since known means and constructions are used for this the rear part of the housing is not shown in the drawings.

In the ram boring machine 1 the main housing 2 is provided with an internal thread 5 at its front end, in the striking direction 4, into which a housing tip or front part 6 having a shank-like threaded extension 7 is screwed. Guided in an axial bore 8 in the housing tip 6 is a chisel 10 shaped at its front end as a striking tip 9, having a shank 11 which extends through the entire housing tip 6 and of which the end 12 facing the main housing 2 projects into the working chamber 13 of the striking piston 3. The length of projection 14 of the shank 11 is smaller than the maximum stroke 15 of the chisel 10 in the striking direction 4; the stroke 15 is given by the distance which a collar 16 of the chisel could theoretically cover between a front and a rear stop 18, 19 in a housing chamber 17 which is enlarged relative to the diameter of the axial bore 8. Since, however, the length of projection 14 is smaller than the stroke 15, the striking piston strikes full on the front face 20 of the housing tip 6 after a stroke of the chisel 10 corresponding to the length of projection 14.

Figure 5:
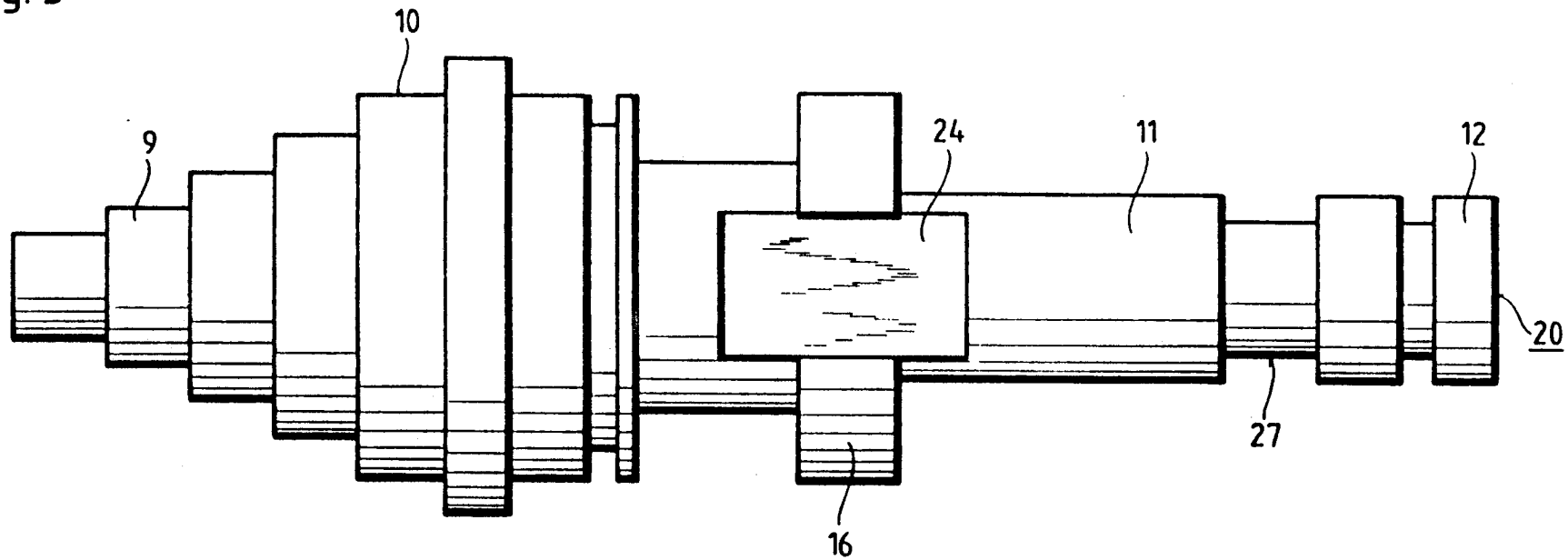
FIG. 5 shows the chisel of FIG. 1 without the housing.

As seen in FIG. 5, the shank 11 is a fixed component of the striker tip 9 of the chisel 10. The components 9–12, are solidly connected with each other, and together form the entire striker tip 9 or chisel 10.

Figure 4:
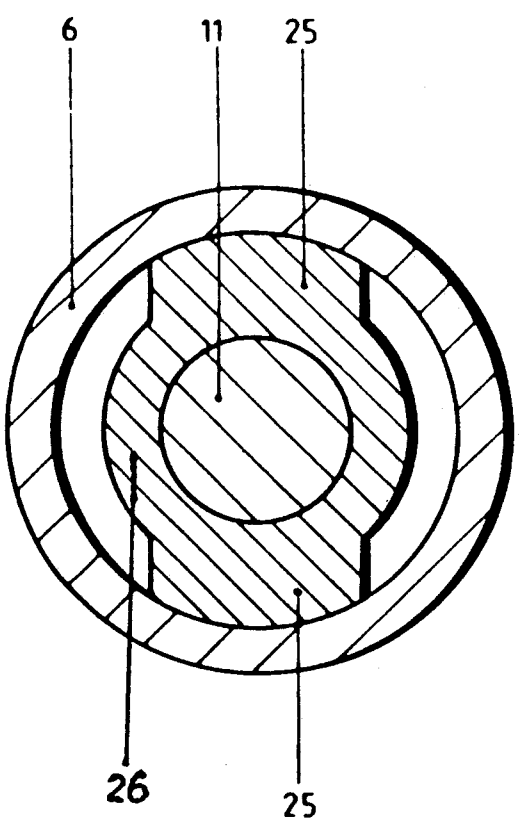
FIG. 4 shows a section through the housing tip shown in FIG. 1 along the line IV—IV.

The housing chamber 17 is limited by the internal collars 21, 22 secured to the housing which at the same time define the stops 18, 19 with their inner surfaces. The through bores 23 in the internal collars 21, 22 are smaller in diameter than the chisel collar 16, which comprises two diametrically opposed shoulder parts 24, and than a support ring 26 (cf. FIG. 4), likewise having two diametrically opposed shoulder segments 25, which is slid on to the shank 11 of the chisel 10, is seated non-rotatably on the chisel and bears with its shoulder parts 25 against the rear end face of the rear internal collar 22 in the striking direction 4. At least one lug 35 on the shoulder part 24 serves to prevent rotation. Between the supporting ring 26 and a two-part counterpart ring 28 spaced therefrom and inserted in a peripheral groove 27 in the shank 11 there is a compression spring 29 surrounding the shank 11. In the working stroke the striking piston 3, moving in the striking direction 4, strikes the front face 20 of the shank 11 and moves the shank 11 and thus the chisel 10 forwards against the force of the compression spring 29 until it meets the stop surface 36, i.e. the front face of the striking tip 7, which limits its forward stroke; after the working stroke the compression spring 29 returns the chisel 10 to its starting position shown in FIG. 1. Seals 30, 31 inserted in grooves in the shank 11 seal the chisel 10 off at the front from the ground and at the back from the working chamber 13 of the striking piston 3 and prevent dirt and earth from entering.

Figure 3:
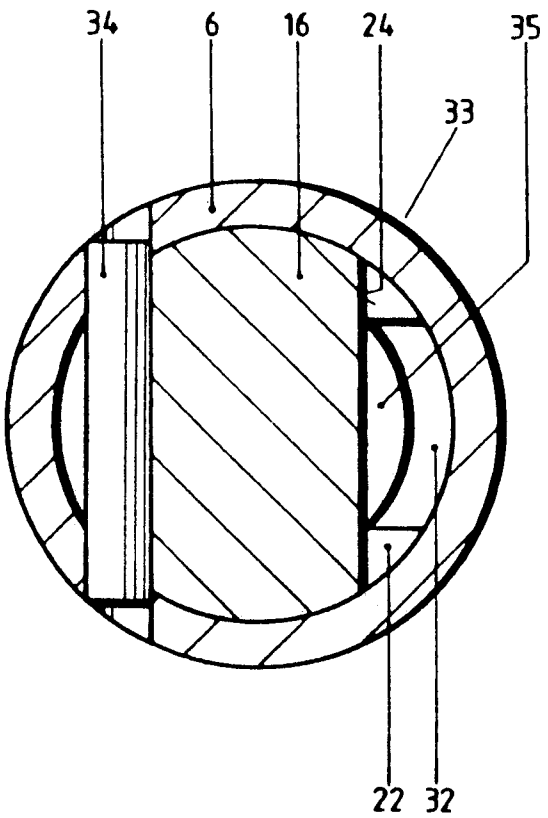
FIG. 3 shows a section through the housing tip shown in FIG. 1 along the line III—III.
Figure 2:
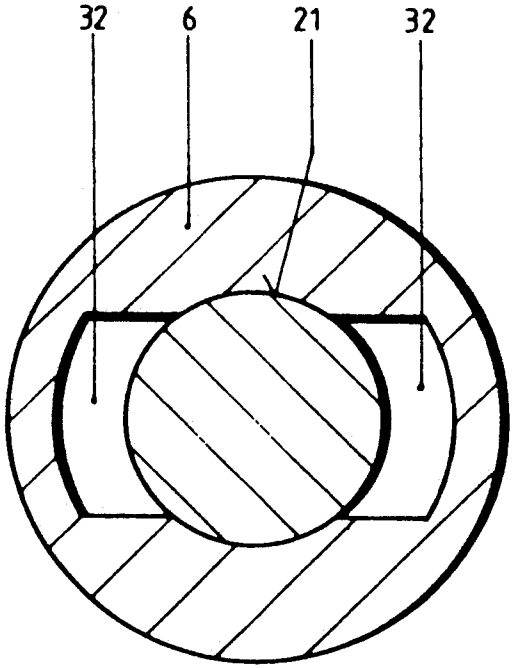
FIG. 2 shows a section through the housing tip shown in FIG. 1 along the line II—II.

The chisel 10 with the rings 26, 28 arranged on the shank 11 and the compression spring 29 supported against these rings and with the seals 30, 31 is pushed into the housing tip 6 as a pre-assembled complete unit and locked therein so that it is secured in position. This is achieved by providing the internal collars 21, 22 with axial passages 32—as shown in FIG. 2 for the front internal collar 21 and in FIG. 3 for the rear internal collar 22—which are adapted to the shape and dimensions of the shoulder parts 24, 25. To install the complete chisel 10 in the housing tip 6 the shoulder parts 24, 25 are aligned with the axial passages 32 so that the chisel 10 can be inserted axially without hindrance. After the chisel 10 has reached its fitting position shown in FIG. 1, in which the end 12 of the shank 11 extends into the working chamber 13 of the striking piston 3 by the length of projection 14, the chisel 10 is rotated radially until the shoulder parts 24, 25—as shown in FIG. 3 for the shoulder parts 24 of the chisel collar 16—extend at right angles to the axial recesses 32 and the chisel 10 is connected to the housing tip 6 by the bayonet joint 33 thus obtained. A locking pin 34 inserted transversely, i.e. radially, through the housing tip 6 prevents the chisel 10 from turning undesirably during operation.

In order to install and remove the chisel 10 which is arranged in the housing tip 6—as shown in the exemplary embodiment—or in a one-piece housing—and which may in particular be axially movable, all that is needed is to remove the locking pin 34 and to position the shoulder parts 24, 25 so that they are aligned with the axial passage 32. The chisel 10, for example when it is worn or the sealing rings and/or the compression spring need(s) to be replaced, can then be pulled out axially from the ram boring machine. For both installation and removal the bayonet joint 33 affords simple handling and ensures secure seating of the chisel in the ram boring machine.

Figure 6:
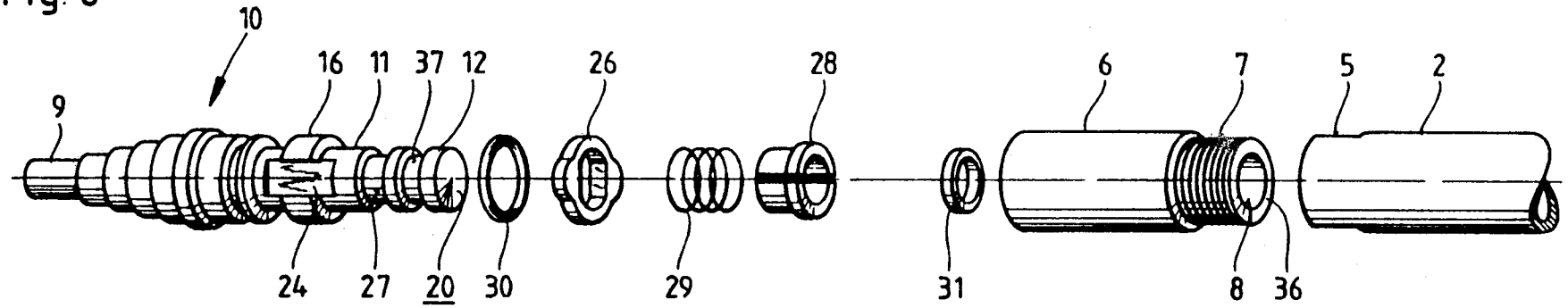
FIG. 6 shows an exploded view of a front portion of a ram boring machine.

From FIG. 6 it can be seen that during assembly, to begin with the seal 30 and then the backup ring 26, comprising two diametrically oppositely located shoulder segments 25, are placed upon the striker tip 9. The backup ring 26 is nonrotatably fixed upon the cylindrical segment of the journal 11 between the chisel collar 16 with the two shoulder pieces 24 and the circumferential groove. Furthermore, the pressure spring 29 is slid upon the journal 11 and the two-part ring 28 is inserted into the circumferential groove 27 on the journal 11. As a result, in connection with FIG. 1, the pressure spring 29 on the journal 11 is clamped between the backup ring 26 and the counter ring 28. Finally, the sealing ring 31 is inserted into the circumferential groove of the journal 11, which groove is referenced "37". The chisel 10 with the rings 26, 28 arranged on the journal 11 and the pressure spring 29 abutting against these rings, as well as the seals 30, 31, is thus present as a complete unit and subsequently must only be slid into the housing tip 6 of the ram boring machine and can be latched there securely in this position by means of the inventive bayonet lock. The housing tip is screwed with its lug-like threaded extension 7 into the main housing 2 of the ram boring machine. The main housing 2 is provided for this purpose with an internal thread 5 in its front end. Once installed, the apparatus appears as illustrated in FIG. 1.

What is claimed is:

1. A quick-change ram boring head having a striking piston arranged to reciprocate in a tubular housing and to strike a first stop surface which serves to limit the forward stroke of said striking piston, and having a striking tip, which also includes a front stop for the striking tip integral with said first stop surface, the striking tip being connected to the housing by means of a bayonet joint, the striking tip being formed as a chisel, the chisel having a shank provided with a collar reciprocating in a chamber in the housing, the chamber being arranged between two internal collars of which at least the front internal collar, in the striking direction, is provided with two diametrically opposed axially passages corresponding to the chisel collar, a compression spring being supported between a support ring having at least one shoulder segment which engages behind the rear internal collar on the side remote from the chisel, and a counterpart ring on the chisel shank.

2. A quick-change ram boring head according to claim 1, wherein the counterpart ring is in two parts and is arranged in a peripheral groove in the chisel shank.

3. A quick-change ram boring head according to claim 1, wherein said housing comprises a front housing part detachably connected to a main housing part, said striking tip is formed as a chisel and said chisel is located in said front housing part.

4. A quick-change ram boring head according to claim 3, wherein said chisel has a shank and a collar on the shank arranged to reciprocate between front and rear stops and a rear end of the shank of said chisel projects rearwardly from said front housing part by a distance not exceeding a maximum stroke of said chisel collar between said stops.

* * * * *